US005806353A

United States Patent [19]

Pages

[11] Patent Number: 5,806,353

[45] Date of Patent: Sep. 15, 1998

[54] CYLINDER LOCK INTERFACE MECHANISM FOR EXTRA BOLTS

[76] Inventor: Enrique Valdes Pages, 31 SW. 132nd Ct., Miami, Fla. 33184-1175

[21] Appl. No.: 975,572

[22] Filed: Nov. 21, 1997

Related U.S. Application Data

[63] Continuation of Ser. No. 707,010, Sep. 3, 1996, abandoned.

[51] Int. Cl.[6] ..... E05B 63/14

[52] U.S. Cl. ..... 70/120; 292/36; 292/34; 70/108

[58] Field of Search ..... 70/108, 113, 118, 70/120; 292/32–36, 39–41

[56] References Cited

U.S. PATENT DOCUMENTS

| | | | |
|---|---|---|---|
| 1,172,846 | 2/1916 | Swanson | 70/118 |
| 1,282,115 | 10/1918 | Older | 292/36 |
| 1,341,038 | 5/1920 | Bickel | 70/120 |
| 1,495,820 | 5/1924 | Tierney | 70/108 |
| 1,607,039 | 11/1926 | Baron | 70/120 |
| 3,953,061 | 4/1976 | Hansen et al. | 292/34 |
| 4,114,933 | 9/1978 | Jankelewitz et al. | 70/108 |
| 4,142,747 | 3/1979 | Beck et al. | 292/37 |
| 4,237,710 | 12/1980 | Cardozo | 70/120 |
| 4,534,192 | 8/1985 | Harshbarger et al. | 70/118 |
| 5,632,166 | 5/1997 | Wiersma | 70/118 |

FOREIGN PATENT DOCUMENTS

| | | | |
|---|---|---|---|
| 1299007 | 6/1962 | France | 292/36 |
| 2385865 | 12/1978 | France | 70/120 |
| 1955116 | 5/1971 | Germany | 70/120 |
| 2317298 | 10/1974 | Germany | 70/120 |
| 445788 | 2/1949 | Italy | 70/120 |
| 529250 | 6/1955 | Italy | 70/120 |

*Primary Examiner*—Darnell M. Boucher

[57] ABSTRACT

This invention add bolts to a cylinder deadbolt lock, to provide extra security to an entrance door from external assault. Bolts added and the cylinder deadbolt lock are interlocked with an interface mechanism, which allow to move simultaneously, the bolts added and bolt of said cylinder deadbolt lock when the latter is actuated, to open or close, with a key from the external side of the door, or with thumb turn or key from the interior side of said door. Bolts added, lock top corner of said door to a clamp on horizontal top corner of door frame, and the bottom corner of said door to a hole in the floor. This device is installed externally on the interior side of said door, to resist a kicking from a force coming from the exterior side, and also for easy installation. This device can be installed on single or double doors.

5 Claims, 4 Drawing Sheets

MECHANISM PARTS SHOWN IN CLOSE POSITION

PARTS A ARE PARTS OF CYLINDER DEADBOLT LOCK MADE BY OTHERS

HOLE IN THE FLOOR

MECHANISM PARTS
SHOWN IN
CLOSE POSITION

CYLINDER LOCK INTERFACE MECHANISM FOR EXTRA BOLTS

CROSS REFERENCE TO RELATED APPLICATION

This application is a continuation of application Ser. No. 08/707,010 filed on Sep. 3, 1996, abandoned.

BACKGROUND OF THE INVENTION

1. Field of this Invention

This Invention relates in general to increase security on any door as, an entrance door in home or business, by adding extra bolts to any Cylinder Deadbolt Lock made by others. More specifically, this Invention relates its use to provide an extra security to an entrance door from kicking assault.

2. Prior Art

With the rapid increase of burglary, it becomes necessary to protect main entrance door, in home or business, with a more secure device which resists kicking assault. Today, most break-ins through an entrance door involve a physical attack.

Many improvements have been made on cylinder deadbolt locks as, having heavier strike plates, adding guard plates, longer screws for strike and guard plates as 3 or 3½ inches long in place of ¾ inch, extra guard to the cylinder deadbolt, but nothing have been added to stop a physical attack on an entrance door as the device of the present Invention.

As far as I know, there is no device to secure an entrance door from kicking assault as the one referred on this Invention.

SUMMARY OF THE INVENTION

The principal object of this invention is to provide additional security to an entrance door with a cylinder deadbolt lock, by adding to the cylinder deadbolt lock at least two bolts, perpendicular to the bolt of the deadbolt lock. On the preferred embodiment, one bolt added locks the upper corner of the door to the door frame, while the second bolt added locks the lower corner of the door to a hole in the floor.

Bolts added are interlocked to the cylinder deadbolt lock through a mechanism which permits to move simultaneously, bolts added and bolt of deadbolt lock, when cylinder deadbolt lock is actuated from the exterior keyed cylinder with a key, or from the interior either with thumb turn or keyed cylinder.

Additional bolts and interface mechanism are mounted externally, on the interior side of the door for double purpose. First, device can be added to a door with a cylinder deadbolt lock, without the need of any special installation, and second, they resist a kicking assault since bolts added protect door from any impact force coming from the exterior.

REFERENCE NUMERAL IN DRAWINGS

Figure 1:
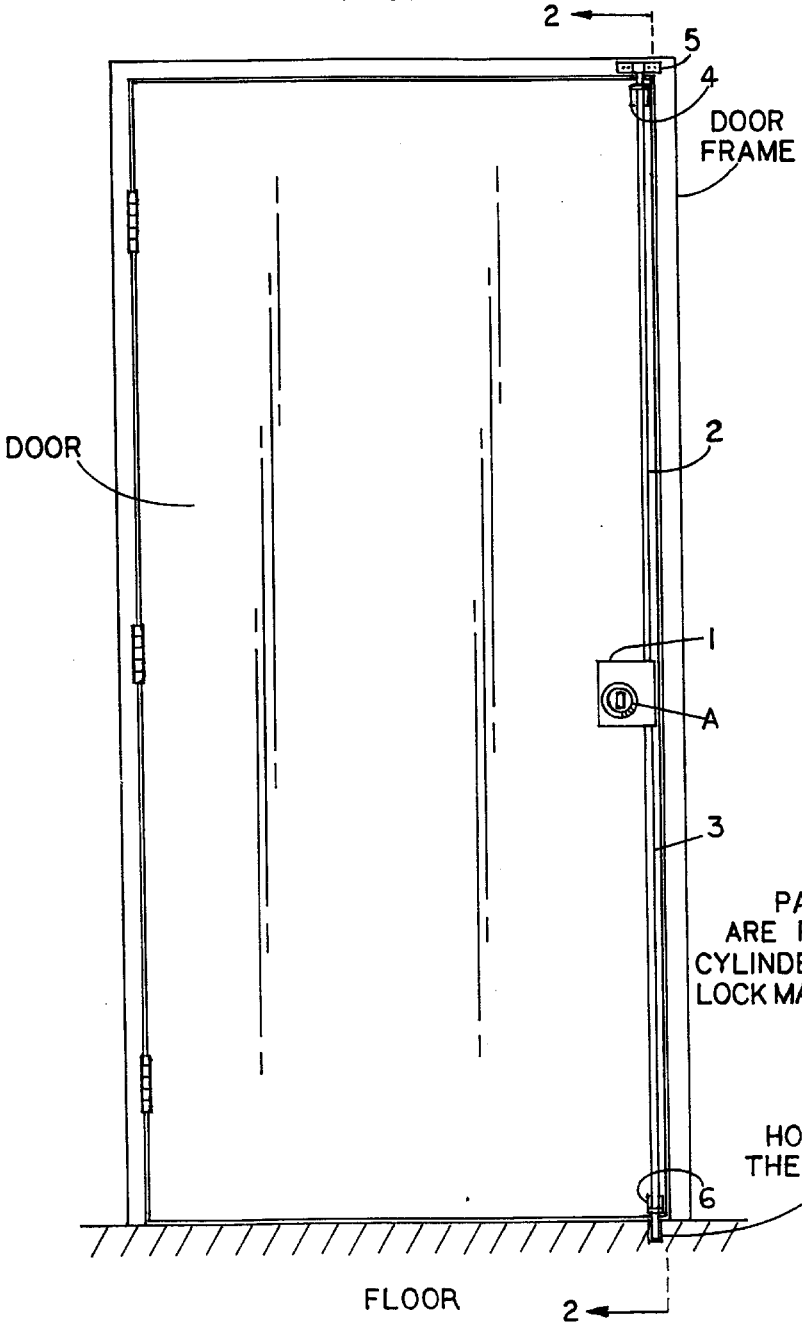
FIG. 1 is a front view of a door, as seen from the interior of location, showing how the device under present invention is installed.

1 Mechanism box 11 Screw
2 Bolt added, upper 12 Washer, flat
3 Bolt added, lower 13 Spacer
4 Bolt guide, upper 14 Washer, flat
5 Bolt clamp 15 Screw
6 Bolt guide, lower 16 Screw
7 Arm, slotted 17 Screw
8 Arm, slotted 18 Cover, mechanism box
9 Lever 19 Screw
10 Shaft, connecting element

DESCRIPTION OF PREFERRED EMBODIMENT

Figure 2:
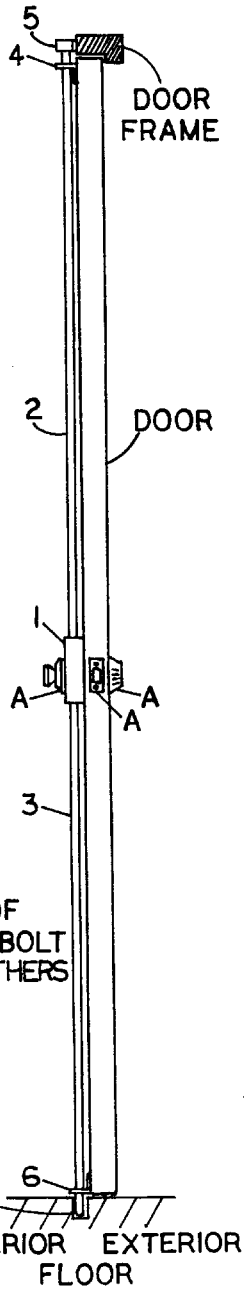
FIG. 2 is a sectional view of the door showing the cylinder deadbolt lock with device under present invention.

Refer to FIG. 1, which shows an overall view of the preferred embodiment of this invention titled, "Extra Bolts Attachment for a Cylinder Deadbolt Lock". It shows that this device is mounted externally on a door, in such way that no additional or special mounting is required. FIG. 2 shows that said device is mounted on the interior side of the door.

Figure 3:
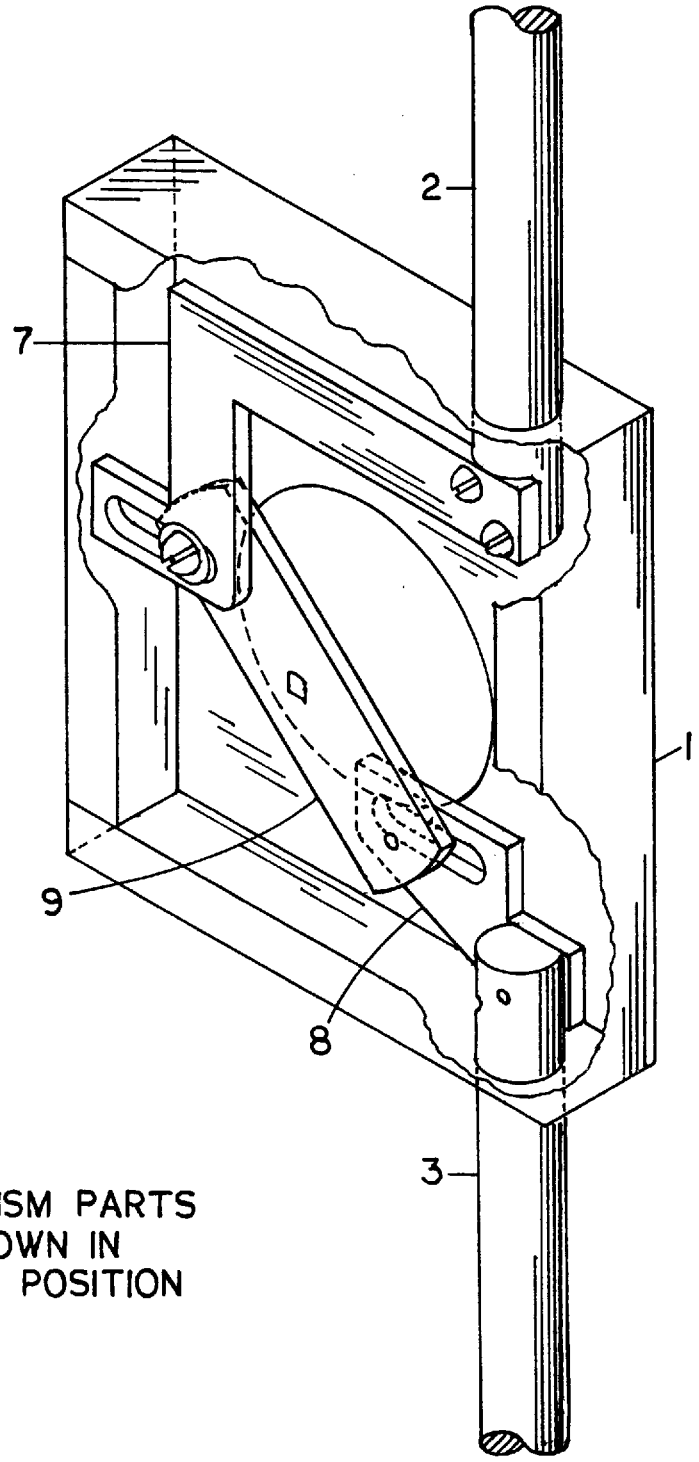
FIG. 3 is a perspective view of mechanism box showing inside parts.
Figure 5:
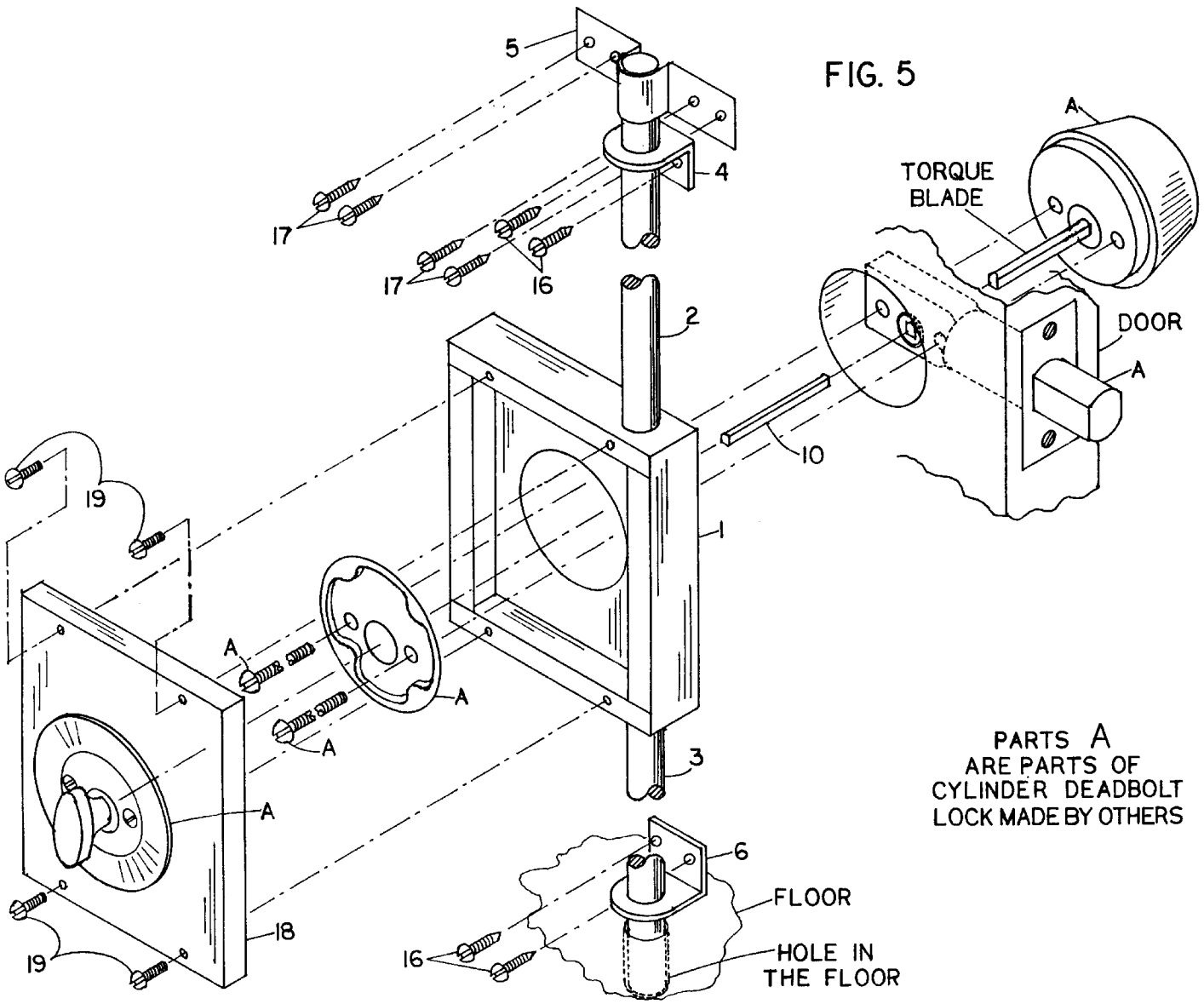
FIG. 5 is an exploded view showing how the device of this invention is interfaced with a standard cylinder deadbolt lock. Mechanism parts inside of mechanism box are not shown in this drawing. See FIG. 3 for details.

Refer to FIG. 5. A mechanism box 1, which contains the parts that move extra bolts 2 and 3, as seen in FIG. 3, is fixed on the door by using original reinforcing steel dish and screws of cylinder deadbolt lock made by others and not part of this invention.

Figure 4:
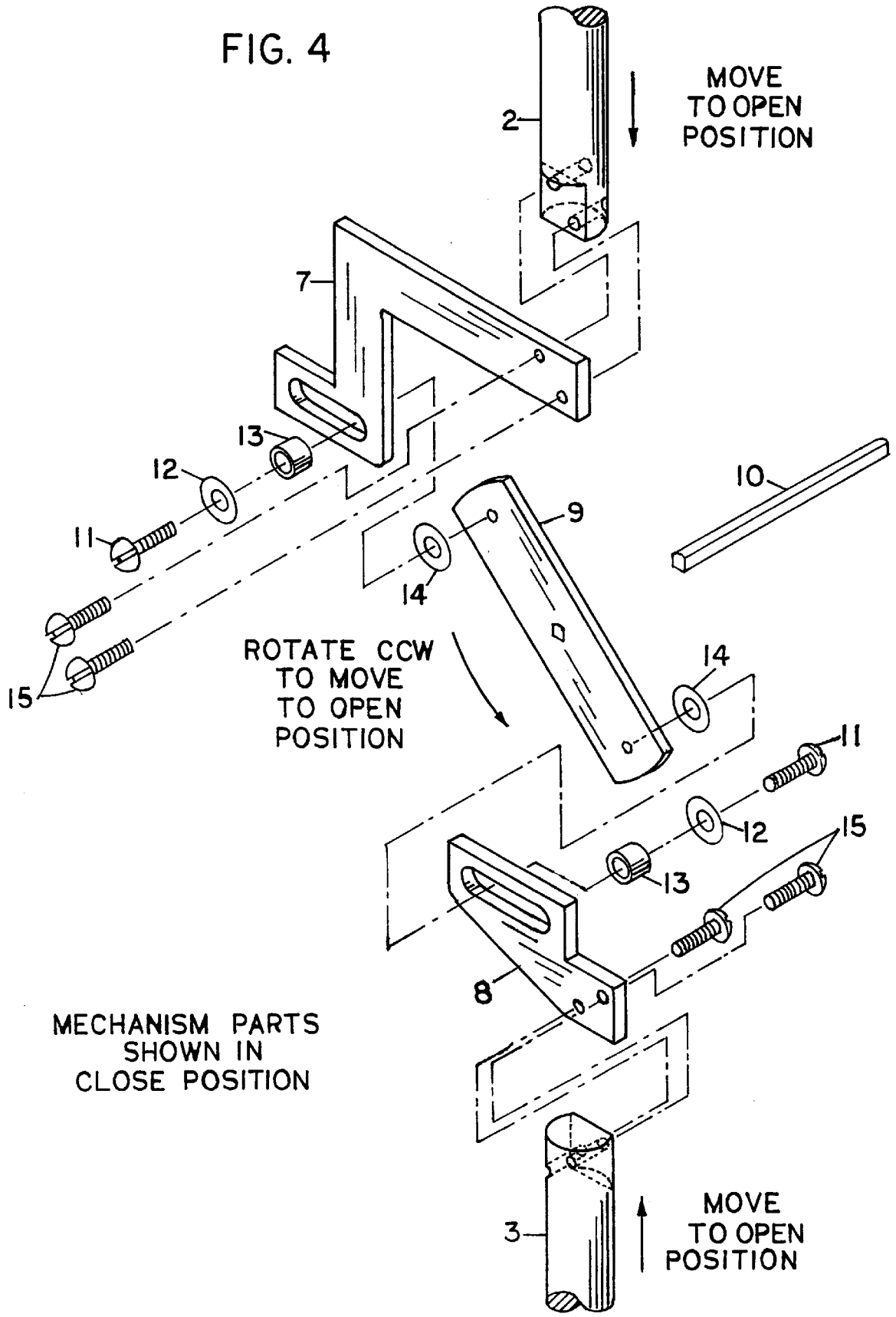
FIG. 4 is an exploded view of mechanism parts enclosed in mechanism box, which move added bolts up or down when actuated by the key or thumb turn of the cylinder deadbolt lock.

Refer now to FIG. 4. Three main mechanism parts 7, 8 and 9 are enclosed in mechanism box 1. Part 7 is an arm tied to upper bolt 2 by using screws 15, while part 8 is an arm tied to lower bolt 3 by using screws 15. Part 9 is a lever which has attached on each extreme and on opposite side, spacers 13 and flat washers 12 and 14 by using screws 11. Flat washers 12 and 14 are used to guide spacers 13 in position within the slots in arms 7 and 8. Spacers 13 slide inside slots of arms 7 and 8. Lever 9 has threaded openings where screws 11 are threaded.

Lever 9 and shaft 10 which goes through a center hole of lever 9, are elements that act as interface to keyed cylinder of cylinder deadbolt lock at the exterior side and thumb turn or keyed cylinder at the interior side. Center hole of lever 9 has same shape of the section of shaft 10 in order that rotation action of shaft 10 could be transmitted to lever 9. Section shape of shaft 10 and shape of center hole of lever 9 varies according to the cylinder deadbolt lock manufacturer. Center hole of lever 9 could have any shape but, in such case, shaft 10 should be made to match the shape of torque blade of cylinder deadbolt lock. Shaft 10 connects torque blade, which is part of exterior keyed cylinder of the cylinder deadbolt lock, to the interior side thumb turn or keyed cylinder mounted on cover 18 of mechanism box 1. Cover 18 is fixed to mechanism box 1 by screws 19. FIG. 5 shows thumb turn on mechanism box cover 18 as preferred option but not the only one. Torque blade goes through deadbolt latch and it is tied to cylinder of cylinder deadbolt lock. In this way, cylinder of cylinder deadbolt lock on the exterior side of the door and thumb turn on the interior side of the door are interconnected with this invention, and move simultaneously extra bolts added 2 and 3, and bolt of cylinder deadbolt lock.

When lever 9 is turned, it pushes in opposite directions arms 7 and 8 with their bolts 2 and 3. Movement action of lever 9 is transmitted through spacers 13 to arms 7 and 8 since spacers 13 slide inside slots of arms 7 and 8.

Range of movement of arms 7 and 8 with their bolts 2 and 3 is controlled by the range of rotation of torque blade of cylinder deadbolt lock, which is around 90°. When lever 9, shown in close position in FIG. 4, is rotated counterclockwise, arms 7 and 8 with their bolts 2 and 3 are moved in opposite directions, moving bolts 2 and 3 inbound or to open position. On the contrary, when device is in open position and lever 9 is rotated clockwise, arms 7 and 8 with their bolts 2 and 3 are moved outbound to close position as shown in FIG. 4.

Refer to FIG. 1. Near upper and lower corners of the door there are bolts guides 4 and 6 to guide bolts 2 and 3 in position. They are fixed on the door by screws 16 as seen in FIG. 5.

When device is moved to close position all bolts are moved simultaneously outbound. Bolt 2 is latched in clamp 5 which is placed on door frame by screws 17, and bolt 3 is inserted in a floor hole. Also, bolt of cylinder deadbolt lock is latched in its strike plate. When moved to open position, bolts 2 and 3 are retracted simultaneously with bolt of cylinder deadbolt lock.

Above detailed description has been considered preferred embodiment but, an alternate embodiment of interface mechanism could achieve same movement of bolts, as an example, using an spur gear instead of a lever, and racks fixed on arms in place of slots. Racks are mounted on the arms in such position that they are parallel to bolts added. One rack on each arm is used. While rotating spur gear, both racks move in opposite direction, where one rack move up or down while the other rack move down or up.

The foregoing detailed description of the preferred embodiment of this invention has been presented for the purpose of illustration and description. It is not intended to be exhaustive or to limit the invention to the precise form disclosed. Many modifications and variations, as using spur gear and racks briefly related, or adding more than two bolts are possible in light of the above teaching. It is intended that the scope of the invention be limited not by this detailed description, but rather by the claims appended hereto.

I claim:

1. A improved cylinder lock interface mechanism having a plurality of extra bolts for acting as a means for conveying mechanical interconnection between a preexisting cylinder lock, and said plurality of extra bolts, the improvement comprises;

said interface mechanism is enclosed in a mechanism box, which said interface mechanism has three main components, including a rotatable shaft extending from the preexisting cylinder lock, providing mechanical interconnection between said interface mechanism and said cylinder lock a lever, with a center hole, and with a plurality of spacers which act as a pivoting point, providing a means for translational movement, a plurality of slotted arms, said slotted arms each having a different configuration and at least one slotted arm having a Z-shape a means for interconnection between said cylinder lock, said shaft, said lever, and said plurality of slotted arms, each of said slotted arms being connected to one of said plurality of extra bolts added, wherein said shaft is adapted to extend through said center hole of said lever, said center hole is a shape equal to the cross sectional shape conforming to said shaft which insures that rotation of said shaft is transferred to said lever, acting as an intermediate element through the slots of said slotted arms, to convert rotation action of said shaft to translational movement of said plurality of extra bolts, whereby said interface mechanism and elements thereof move said plurality of extra bolts.

2. The mechanism as defined in claim 1, further comprising in combination;

a plurality of clamps, adapted to be attached on a fixed door frame where a door is mounted, and a plurality of holes are in the floor, said clamps and the holes are keepers adapted to anchor said plurality of extra bolts to the fixed door frame when said bolts are moved into said keepers, said plurality of keepers are located adjacent to the edges of said door panel, a plurality of guides adapted to be externally mounted on a door surface are a means for guiding and aligning said plurality of extra bolts in said keepers, whereby said mechanism provides a means of extra security against kicking assault and windstorm pressures to a door.

3. The improved mechanism as defined in claim 2, wherein said plurality of extra bolts is adapted to move simultaneously with a bolt of the cylinder lock when the lock is rotated either by a key or a thumb turn of the cylinder lock, said extra bolts are in the closed position when moved into said keepers and are in the open position when retracted from said keepers.

4. The improved mechanism as defined in claim 1 in combination with a door having an interior side and an exterior side, wherein the mechanism is mounted on said door on said interior side externally of the door core to avoid any destruction or weakening of the door core.

5. The improved mechanism as defined in claim 4 wherein the door is a single or double panel door.

* * * * *